US008127580B2

(12) United States Patent
Polatidis et al.

(10) Patent No.: US 8,127,580 B2
(45) Date of Patent: Mar. 6, 2012

(54) METHOD FOR LEVELLING A FLAT PRODUCT IN STRIP OR SHEET FORM IN A LEVELLING MACHINE WITH INTERMESHED ROLLS AND LEVELLING INSTALLATION THEREFORE

(75) Inventors: Dominique Polatidis, St-Priest-en-Jarez (FR); Yves Leclercq, L'Etang-la-Ville (FR)

(73) Assignee: Siemens VAI Metals Technologies SAS, Saint-Chamond (FR)

( * ) Notice: Subject to any disclaimer, the term of this patent is extended or adjusted under 35 U.S.C. 154(b) by 411 days.

(21) Appl. No.: 12/094,185

(22) PCT Filed: Nov. 15, 2006

(86) PCT No.: PCT/FR2006/002525
§ 371 (c)(1),
(2), (4) Date: Oct. 7, 2008

(87) PCT Pub. No.: WO2007/060310
PCT Pub. Date: May 31, 2007

(65) Prior Publication Data

US 2010/0058823 A1 Mar. 11, 2010

(30) Foreign Application Priority Data

Nov. 22, 2005 (FR) ..... 05 11930

(51) Int. Cl.
*B21D 1/02* (2006.01)
*B21D 1/06* (2006.01)
*B21B 37/00* (2006.01)

(52) U.S. Cl. ..... 72/7.4; 72/8.3; 72/11.1; 72/11.2; 72/31.07; 72/164

(58) Field of Classification Search ..... 72/7.2, 72/7.4, 8.1, 8.3, 10.4, 10.7, 11.1, 11.2, 28.2, 72/31.07, 160, 162, 163, 164, 165
See application file for complete search history.

(56) References Cited

U.S. PATENT DOCUMENTS 4,593,549 A * 6/1986 Moriya et al. ..... 72/11.4
(Continued)

FOREIGN PATENT DOCUMENTS

FR 2732913 10/1996
(Continued)

OTHER PUBLICATIONS

International Preliminary Examination Report dated Jul. 17, 2008.

*Primary Examiner* — David Jones
(74) *Attorney, Agent, or Firm* — Laurence A. Greenberg; Werner H. Stemer; Ralph E. Locher

(57) ABSTRACT

A method and a device is provided for controlling the overlapping of leveling rollers in a planishing machine comprising two leveling trains each bearing a series of rollers with parallel axes. The method and device are particularly applicable to sheets and strip products of great thickness and high hardness requiring little roller overlap. The method is characterized in that it consists in measuring at least the overall value of the torques transmitted to the planishing rollers by the motors, in determining the actual value of the torques used for planishing the product, in comparing the determined value with the reference value of the torque provided by the presetting model and in acting on the members regulating the roller overlap to maintain the value of the thus determined torque at the reference value.

15 Claims, 5 Drawing Sheets

U.S. PATENT DOCUMENTS 4,881,392 A 11/1989 Thompson et al.
5,461,895 A * 10/1995 Lemper et al. ..... 72/9.1
5,622,072 A * 4/1997 Benz ..... 72/163
5,874,813 A 2/1999 Bode et al.
6,029,485 A * 2/2000 Bohmer ..... 72/7.4
7,475,581 B2 * 1/2009 Farnik ..... 72/160
7,617,710 B2 * 11/2009 Bourgon et al. ..... 72/165

FOREIGN PATENT DOCUMENTS

JP 60174214 9/1985

* cited by examiner

Fig. 3 bis

Fig. 4 bis

METHOD FOR LEVELLING A FLAT PRODUCT IN STRIP OR SHEET FORM IN A LEVELLING MACHINE WITH INTERMESHED ROLLS AND LEVELLING INSTALLATION THEREFORE

BACKGROUND OF THE INVENTION (1) Field of the Invention

The subject-matter of the invention is a method to level a flat product in strip or sheet form in a levelling machine with intermeshed rolls, and the levelling installation which can be used to implement the method.

(2) Prior Art

To level flat products and, in particular rolled metal strips and sheet, a levelling machine is often used having multiple rolls comprising two sets of levelling equipment each carrying a series of rolls with parallel axes and respectively positioned above and below the strip, the rolls being staggered longitudinally and vertically so that they intermesh thereby defining a bending pathway for the work strip which is therefore subjected to tensile bending effects in alternate directions. Motors are used to actuate the rolls in rotation and, by friction, the product is caused to travel forward at a determined velocity. To level thick strips and sheet metal these sets of equipment operate without the application of any external tension forces either upstream or downstream of the machine.

The functioning of said machine has been the subject of advanced theoretical approaches. These levelling theories are based on the calculation of the maximum curvatures of the sheet metal in the levelling machine, these curvatures generating plastic deformation of the material in the thickness of the product which determines the relaxing of stresses in width and thickness. Depending on the extent of roll intermesh and diameter, the product assumes a greater or lesser curvature, and plastic deformation affects a greater or smaller part of the thickness. One adjustment parameter for levelling is the plastic deformation rate, which represents the ratio between the thickness of the product in which the stress has exceeded the elastic limit, deformation is therefore plastic, compared with the total thickness of the product. Evidently the remainder of the thickness of the product remains at an elastic deformation stress value. These two regions in the thickness of the product each have an influence on levelling force and the torque values to be transmitted to the rolls, but the variations they generate with respect to levelling parameters follow different laws.

Finally, in a levelling machine a distinction is generally made between two zones, whose functions are substantially different but complementary and interactive. An entry zone which is a zone of substantial plastic deformation preferably treating geometric planarity defects, and an output zone in which levelling more concerns de-tensioning and takes place with low plastic deformation or even by alternate bending within the elastic limit of the material.

It is known how to establish theoretical calculations to arrive at an accurate result and which may be used for pre-adjustment of the machines. The principle is based on progressive decrease of the plastic deformation rate. This can only be achieved with machines comprising a sufficient number of levelling rolls and allowing adequate adjustment of the intermesh of each of its rolls.

Roll intermesh depends on the required plastic deformation rate and on the thickness and temperature of the sheet to be levelled. For steel sheet leaving a hot rolling mill, generally a high plastic deformation rate is required, in the order of 70%. To obtain this rate with thick sheet only a slight intermesh is needed, but at the same time levelling forces are very high having a tendency to draw the levelling rolls away from one another and to reduce the intermesh. This means that the deflection of the rolls, also called camber, produced by the levelling forces is much higher than the value of intermesh needed for plastic deformation. A problem is therefore raised relating to the precision with which it is possible to control the value of the intermesh, and of determining a control method to ensure the same.

A levelling installation therefore generally comprises a fixed support stand, two sets of levelling equipment with parallel rolls, respectively positioned above and below the workpiece and whose rolls intermesh so as to define a bending pathway for the workpiece, and means to adjust and maintain the spacing of said sets by action on the fixed stand to adjust the intermeshing of the rolls, each set of levelling equipment comprising a row of parallel work rolls bearing on a support frame via at least one row of back-up rolls, each mounted rotatably at their ends on two bearings defining a rotation axis perpendicular to the direction of travel, said bearings being respectively carried by two lateral parts secured to the supporting frame.

In a levelling machine to level very thick sheet and strip metal, the work rolls are motorized by electric motors since substantial torque must be transmitted to each roll to ensure deformation and forward travel of the product inside the levelling machine.

Most often the lower levelling set is fixed in position, the upper levelling set being able to move vertically for adjustment of the intermesh. For this purpose four mechanical or hydraulic actuators are generally used, mounted at the corners of the frame and allowing the general level of the adjustable set of equipment to be adjusted relative to the fixed lower set, and hence providing adjustment of the roll intermesh. Additionally, the actuators can be adjusted independently and at different values, making it possible to determine switching between the entry and exit of the levelling machine, generally needed when it is required to achieve different levelling effects according to needs.

Efforts developed for levelling are very high, in particular when this operation is conducted on strong sheet metal after hot rolling and accelerated cooling, or on cold sheet. This leads to providing levelling machines with a structure that is as rigid as possible, so that levelling effects can be controlled. Deformation of the different parts of the machine under load distorts the accuracy of control over the position of the levelling rolls, and hence of the curvature value obtained on each roll, and may in some cases make such accuracy impossible.

For example, for steel sheet 50 millimeters thick, the calculated value of the intermesh is in the order of 0.3 millimeter, however the levelling forces are sufficiently high to cause camber of the machine in the order of a dozen millimeters. It is therefore obvious that the direct application of a levelling method such as the one described in U.S. Pat. No. 4,881,392 is not possible. Also, rolling tolerance on sheet metal such as cited is in the order of 0.1 millimeter. However a levelling machine must be able to open up to the value of the nominal thickness of the sheet metal to allow it to pass, but variations in thickness due to manufacturing tolerances must not cause variations in the plastic deformation rate, and must not therefore cause a variation in roll intermesh.

To overcome these drawbacks, levelling machines with hydraulic control have been produced for displacement of the mobile set of levelling rolls, and also for individual control of each levelling roll, and a camber model based on force measurements has been associated with a theoretical calculation of machine deformation under load, to offset these deformations, but all such offsets are flawed due to the non-linearity of machine camber and it is not realistic to consider offsetting a defect whose amplitude is ten or more times greater than the parameter to be controlled.

SUMMARY OF THE INVENTION

The subject of the invention is therefore a method which can be used to control roll intermesh with desired accuracy and to solve all the above problems without leading to any complications or excessive cost of the devices used.

The very principle of levelling by alternate bending consists of imparting a curvature to metal products alternately in one direction then in the other, using rolls whose intermeshing is adjusted. During this operation, that part of the product thickness in contact with the roll, also called the intrados, undergoes compression stresses and the outer part, called the extrados, undergoes tensile stresses. In the central region of the product there is a line along which stresses are zero, called the neutral axis. Depending on the thickness of the metal sheet and the curvature imparted to the product, it is possible to exceed the elastic limit of the material and to produce plastic deformation. According to the number of rolls of the levelling machine, a certain number of alternate plastic deformations will occur in at least part of the product thickness. Depending on the defects of the sheet to be treated, the product can be subjected to levelling by alternate bending within the range of elastic deformation or within the range of plastic deformation.

As a general rule, to level thick steel sheet the levelling machine is adjusted to produce plastic deformations at least at the first part of the machine, near the entry, and lesser deformations at the exit end. For strong sheet metal machines having 7, 9 or 11 rolls are generally used. Typically plastic deformation rates of 30%, 70%, 40% then 20% are targeted on the first rolls of a levelling machine.

The rolls of levelling machines are driven in rotation by electric motors to cause the product to travel forward and impart the necessary energy to the product for its deformation.

Theoretical levelling models are used to determine the torques to be transmitted for such deformations, and the necessary intermesh. When, on account of camber, the intermesh does not lie at the planned value, it is not possible to deform the product sufficiently and it has been observed by the registrant company that the actual value of the torques transmitted by the electric motors is much lower than the theoretically determined value. Quantified observations have therefore allowed a method to be designed for controlling intermeshes based on the observed value of applied torques compared with the theoretical torques estimated by models, or compared with the desired pre-adjustment.

The offsetting of camber is therefore replaced by a real-time calculation model, or other pre-adjustment device, of the torques to be transmitted to the levelling rolls, associated with intermesh adjustment, and by measurement of the torques actually applied, with action on the position of the rolls of the levelling machine to adjust their intermeshing.

According to the method of the invention, at least the global value is measured of the torques transmitted to the levelling rolls, and the actual value of the torques applied for plastic deformation of the product is determined, the determined value is compared with the reference torque value given by the pre-adjustment model, and action is exerted on the adjustment members (3) of roll intermesh to maintain the determined torque value used for plastic deformation equal to the reference value ($Ref_C$) given by the model. Still according to the method of the invention, the measurement of the torques transmitted to the levelling rolls is corrected by the value of the acceleration and deceleration torques applied when changing the speed of the levelling machine.

With respect to a levelling machine consisting of several parts whose rolls are motorized independently in groups, each group corresponding to one of the parts of the levelling machine, each part comprising separate roll intermeshing means, a theoretical model or a pre-adjustment device giving at least one reference speed value for the motors of the levelling rolls and for the value of the electric torque required for plastic deformation of the product in each part of the machine, according to the invention at least the global value of the torques transmitted to the corresponding group of levelling rolls is measured in each part, and the actual value is determined of the torques used for plastic deformation of the product in each of the parts, the determined value is compared with the reference torque value given by the pre-adjustment model for the same part of the machine, and action is exerted on the members adjusting the intermesh of the levelling rolls of said part to maintain the determined torque value used for plastic deformation of the product equal to the reference value given by the model.

According to the method of the invention, a measurement or calculation is made of the tension induced in the product at the different parts of the machine having independent motorization, and for each part a determination is made of the actual value of the torques used for plastic deformation of the product, by correcting the measurement with the torque values required for tension equilibrium in the product in the zones located between each part of the levelling machine.

In particular, and still according to the method of the invention, in a levelling machine consisting of two parts, one entry part comprising a certain number of levelling rolls, and respectively an exit part also comprising a certain number of levelling rolls, at least the global value is measured on the entry and exit rolls respectively of the torques transmitted to said rolls, and the actual value is determined of the torques used for plastic deformation of the product at the entry and exit respectively, the determined value is compared with the reference torque value given by the pre-adjustment model respectively for the entry and exit of the machine, and action is exerted on the members adjusting the intermesh of the entry and respectively exit levelling rolls, to maintain the determined torque value used for plastic deformation of the product equal to the reference value given by the model.

Determination is made of the actual value of the torques used for plastic deformation of the product at the entry and exit of the machine respectively, by correcting the measurement with the acceleration and deceleration torque values used when changing the velocity of the levelling machine, and the value is also determined by measurement or calculation of the tension induced in the product in the zone located between the entry and exit rolls and, both for the entry and exit, the actual value is inferred of the torques used for plastic deformation of the product by correcting the measurement with the torque values required for tension equilibrium in the product in said zone located between the entry and exit rolls.

According to the method of the invention, in a levelling machine in which all the rolls are motorized individually and independently and comprise separate means (52) to intermesh each roll, a theoretical model or a pre-adjustment device giving at least one velocity reference value for the motors of the levelling rolls and the value of the electric torque needed for plastic deformation of the product, the value of the torque transmitted to each levelling roll is measured and the actual value is determined of the torques used for plastic deformation of the product, the determined value is compared with the torque reference value given by the pre-adjustment model for the same roll, and action is exerted upon the members (52) adjusting the intermesh of said levelling roll to maintain the torque value thus determined for plastic deformation of the product equal to the reference value given by the model. To determine the torque value required for plastic deformation of the product, the measurement is corrected with the acceleration and deceleration torque value applied when changing the velocity of the levelling machine, and by measurement or calculation determination is made of the tension induced in the product between each roll, and the measurement is also corrected with the torque value required for tension equilibrium in the product between the upstream and downstream part of each roll.

According to the invention, the device to adjust the intermesh of the rolls in a machine to level flat products in strip or sheet form, comprises a roll velocity adjustment circuit (105) allowing servo-control by the velocity reference given by the model, and a roll intermesh adjustment circuit acting on the position of the rolls by adjusting the difference between the torque reference required for plastic deformation of the product given by the model and the measurement taken on the rolls.

In a levelling machine consisting of several parts in which the rolls are motorized independently in groups, each group corresponding to one of the parts of the levelling machine, each part comprising separate means for roll intermesh, the device of the invention comprises a roll velocity adjustment circuit (105) allowing its servo-control by the reference velocity given by the model, and a roll intermesh adjustment circuit for each part acting separately on the position of the rolls of each part.

In a levelling machine consisting of several parts whose rolls are motorized independently and individually, each roll comprising separate intermeshing means, the device of the invention comprises a roll velocity adjustment circuit (105) allowing its servo-control by the velocity reference given by the model, and a separate circuit to adjust the intermesh of each of the rolls which acts separately on the position of said rolls.

According to the invention the device to adjust roll intermesh in a machine to level flat products is of proportional, integral and differential type, and it comprises inputs for the acceleration signals of the machine and for the differences in tension induced in the product between the upstream and downstream zones of each roll.

BRIEF DESCRIPTION OF THE DRAWINGS

However the invention will be better understood through the description of an embodiment with reference to the following figures:

FIG. 3*bis* shows the stresses in the product (plastic deformation),

FIG. 4*bis* schematically illustrates adjustment according to an improved embodiment of the invention.

DETAILED DESCRIPTION OF THE PREFERRED EMBODIMENT(S)

Figure 2:
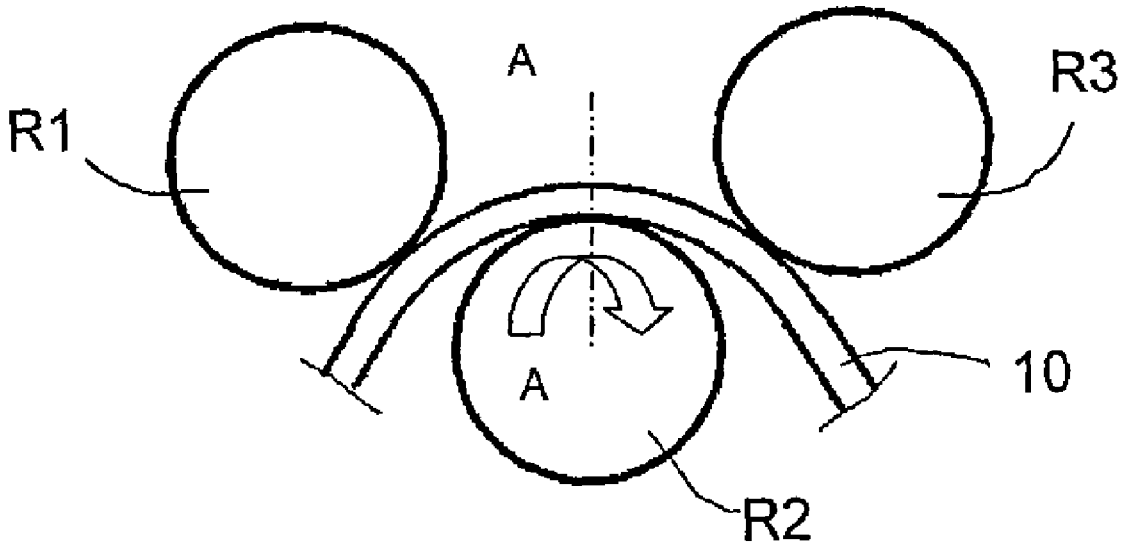
FIG. 2 illustrates reverse bending under levelling.
Figure 3:
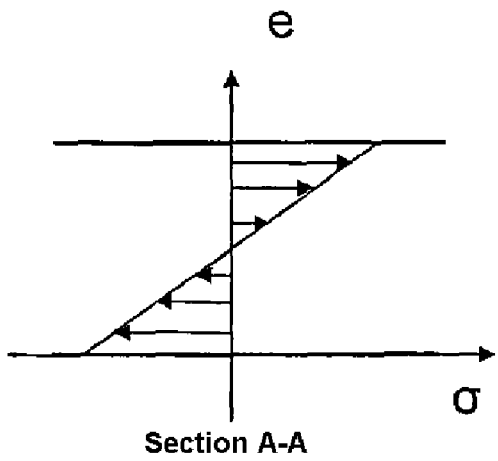
FIG. 3 shows the stresses in the product (elastic deformation)

As shown FIG. 2, a first bend is produced on a product 10 in a levelling machine by a group of three rolls R1, R2 and R3. The product is bent around the central roll R2 which is intermeshed between the end rolls R1 and R3. It assumes a radius of curvature close to the radius of the roll, which depends on the intermesh of the rolls, the mechanical strength of the product and its thickness t. The face in contact with the roll, the intrados, lies under compression and the outer face, the extrados, is under tension as shown FIG. 3. The laws of material strength show that variation is linear in the thickness of the product, for as long as the stress $\sigma$ is less than the elastic limit. A central region exists without any stress: the neutral axis.

If bending is greater, the material's elastic limit may be exceeded in regions of maximum stress. In this case, stress is constant and equal to the maximum value in the region of plastic deformation, as is shown FIG. 3*bis*. It can be observed that each bend, in one direction then in the other, is formed by a group of three rolls. Therefore a levelling machine is generally designed with an uneven number of rolls to form an even number of bends and to avoid the risk of maintaining a permanent deformation on the product due to the levelling operation.

Evidently during this operation the product 10 exerts forces on the rolls, and the greater the intermesh and deformation the higher the values of these forces. If it is remained within the range of elastic deformation corresponding to FIG. 3, force is proportional to deformation, as indicated by the laws of material strength. Thereafter, the force value gradually saturates when the entire thickness t of the product has been plastically deformed.

Figure 1:
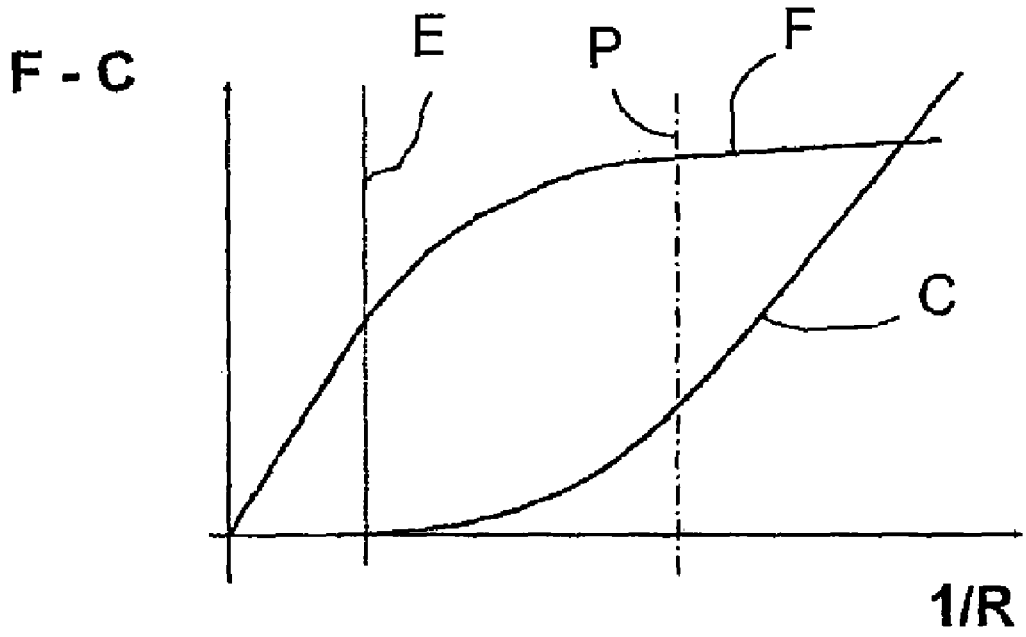
FIG. 1 shows force and torque in the elastic and plastic regions.

FIG. 1 illustrates all the observations made and the results obtained from modelling work by the registrant company. Since curvature varies inversely to the radius of curvature R assumed by the product, the curvature is shown in this figure as 1/R along the abscissa. Depending on the curvature imparted to the product, the stress $\sigma$ may reach the elastic limit E firstly in the regions close to the upper and lower surfaces. Then, when curvature increases, regions of plastic deformation in which stress is constant at first approximation, extend towards the centre and may account for most of the thickness t of the product 10.

In the first part of the graph, the force F exerted on the rolls is substantially proportional to the curvature, and hence to the intermesh given to the levelling rolls. This force then progressively reaches a substantially constant value when the entire thickness of the product 10 is plastically deformed. This further illustrates the problem raised, it is not possible to control the intermesh of the rolls in this region by controlling the force, since the force practically no longer varies.

However this does not apply to the torques needed to drive the product forwards. The torques required to deform the product within the limits of the elastic range are zero. In this case the stress state in the product changes from zero stress to a state such as illustrated FIG. 3. This requires the providing of a certain amount of mechanical work so that the product assumes a radius of curvature R, which takes place at the entry into the levelling rolls in the direction of travel of the product, but at the exit of each roll it is the product which provides an equivalent work force via its elastic return. The outcome for the roll is zero, in other words on each levelling roll the entry region is resistant and the exit region is motive, the mechanical work schedule to be provided is zero.

On the other hand, it is necessary to supply energy to the product when it is in the plastic deformation region, since permanent deformation takes place. This is true for each bend since deformation is conducted alternately. This energy is evidently proportional to the plastically deformed region and hence to the thickness t of this region, and consequently to the intermesh of the levelling rolls. This is illustrated FIG. 1. For as long as the deformation of the product 10 is elastic the torques to be supplied are zero, they gradually become proportional to the curvature and hence to the intermesh. Within the range already cited of the values used to level metal sheet i.e. 20% to 70%, the progression of the torque is very substantially linear. It is therefore fully possible according to the method of the invention, to carry out control over the intermesh of the levelling rolls by determining the torque values consumed for plastic deformation. For this purpose a device must be designed permitting such determination, and a device permitting adjustment of the intermesh of the levelling rolls.

Figure 5:
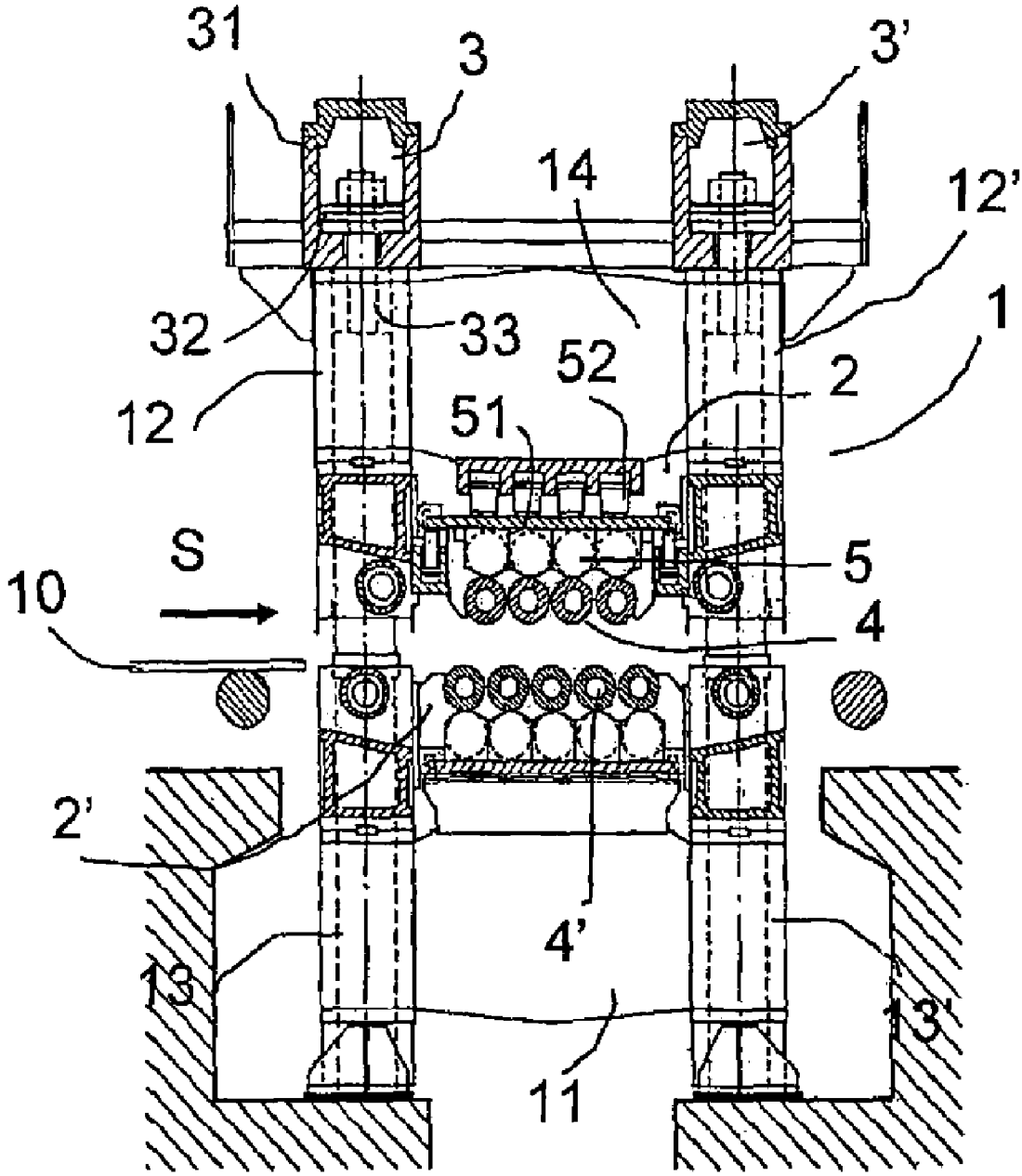
FIG. 5 is a side elevation view of a levelling machine

FIG. 5 shows a machine with 9 rolls. Generally speaking a levelling machine consists of a fixed support stand 1, an upper levelling set 2 and a lower levelling set 2'. The fixed support stand 1 generally comprises a bottom support slab 11, two side uprights 12, 13 positioned either side a longitudinal median plane of the direction of travel of the product 10 to be levelled, and an upper support slab 14.

Having regard to the size of said installation, its lower part may advantageously be positioned in a pit arranged in a foundation block carrying two spaced apart beams or other rigid parts forming a fixed seating on which the bottom support slab 11 rests.

Also, the two support parts i.e. the bottom 11 and upper 14 support each consist of a welded structure forming a rigid slab of substantially rectangular shape, which covers the entire surface occupied by the sets of levelling rollers 2, 2' between the side uprights 12, 13.

Each side upright 12 (13) consists of a pair of spaced apart columns 12, 12' (13, 13'). These columns and the upper support part, generally forming a rigid slab, are equipped with varied devices largely described in the prior art which are able to cooperate to allow vertical sliding of the upper slab 14 along the four columns 12, 12', 13, 13'. This movement may be mechanical using motorized or hydraulic screws as shown FIG. 5. In this case four jacks 3, 3' are installed at the top of each column. In the device shown each jack consists of a body 31 fixed to the slab 14 and of a piston 32 secured to a rod 33 fixed to the corresponding column 12, 12', 13, 13'.

As the lower slab 11 is fixed, the upper slab 14 is therefore able to be moved under the action of the jacks 3, 3', the pistons of the jacks remaining at the same level. The jacks 3, 3' are positioned to adjust the desired intermesh of the rolls relative to the thickness of the sheet to be levelled, so as to carry out the reverse bending determined by the theoretical model or which is stored in the memory of the pre-adjustment device. They exert levelling forces during the pass of the product.

Each set of levelling equipment comprises a row of work rolls 4 associated with a row of back-up rolls 5, the whole being carried by a frame 2. Each work roll 4 is rotatably mounted on two bearings defining its axis of rotation, and bears upon a back-up roll 5 mounted rotatably on end bearings 51. In the illustration given FIG. 5 these end bearings are supported by the frame 2 via a support member 52. In a more elaborate version of the invention, this support member may comprise an adjustment device which can be used to modify the intermesh of each active roll individually, the global value of the intermesh being provided by positioning the frame 2 via jacks 3, 3'. These adjustment devices may be mechanical, such as a system of wedges, or they may consist of hydraulic jacks.

It is also possible in a levelling machine to adjust the jacks 3 located on the entry side of the machine differently to those 3' located on the exit side, so as to give rolls 5 a progressively decreasing intermesh and thereby achieve major plastic deformation of the product 10 at the start of the operation and subsequent levelling with lesser plastic deformation or remaining within the elastic limit at the end of the operation. The direction of travel of the product 10 is denoted S in FIG. 5.

Said levelling machine comprises a motorization device capable of driving in rotation all the upper and lower active rolls 4 and 4'. For this purpose a motor 9 is connected to a gear reducer 8 which itself is connected to a gear box 7. This gear box distributes the required torque to each active roll 4 and in the proper direction of rotation via a plurality of hinged transmission extensions 6.

As already mentioned, it is of advantage to adjust part of the machine with a different intermesh to the other part, and thereby to separate the entry from the exit of the machine. In this case, the torques to be transmitted to the entry rolls which conduct strong plastic deformation are notably higher than those to be transmitted to the exit rolls which work within the elastic range of the product 10 or at least with low plastic deformation. It is therefore highly advantageous to install two different motorizations for said machine, one for the entry rolls and the other for the exit rolls.

Figure 7:
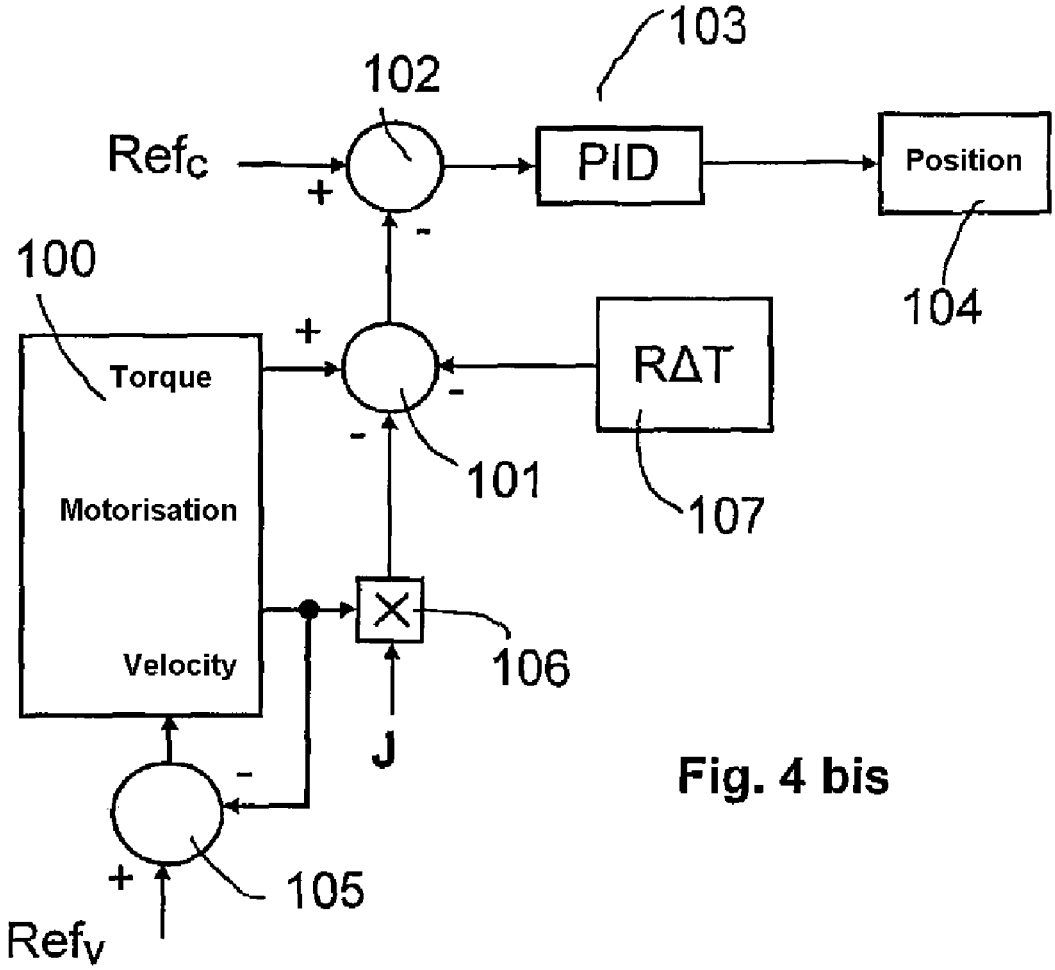
FIG. 7 is a detailed view of the motorization pinion gear assembly.
Figure 7:
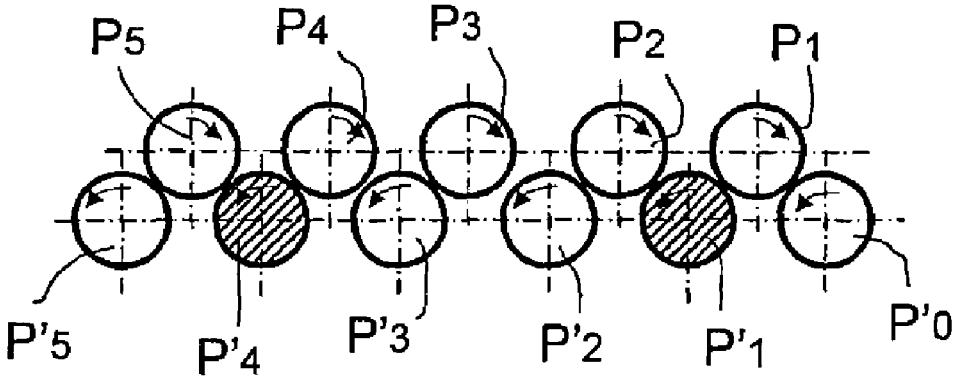
Figure 6:
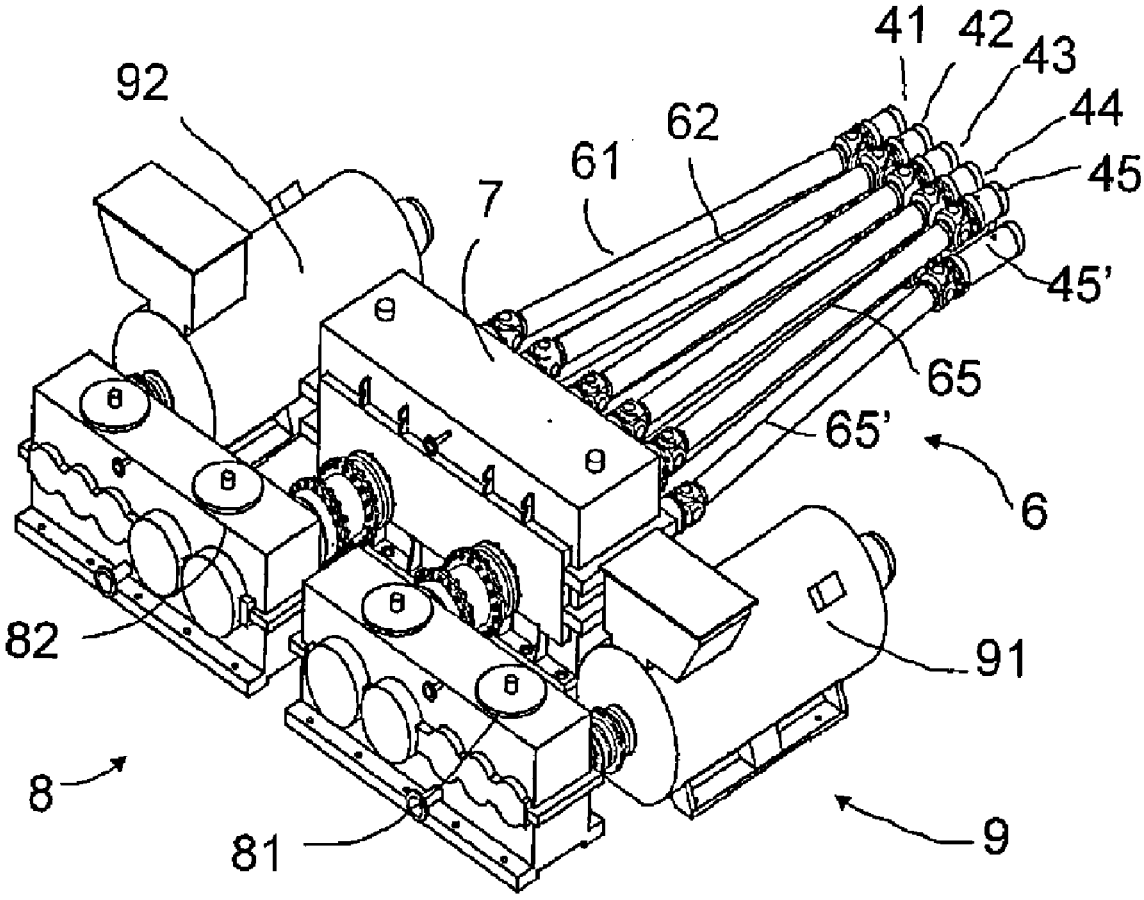
FIG. 6 is a perspective view of the motorization of a levelling machine.

It is this type of motorization which is illustrated FIGS. 6 and 7. The example shown is for a levelling machine with 11 active rolls, five upper rolls 41, 42, 43, 44, 45 and 6 lower rolls 40', 41', 42', . . . 45'. In usual manner a motorization transmits the motor torque to the five first rolls 40, 41, 41', 42, 42' at the entry of the machine, and the second motorization transmits the motor torque to the 6 active rolls at the exit end of the machine 43, 43', 44, 44' and 45'. Each work roll is linked to an output shaft of the pinion gear assembly via a hinged transmission shaft 60, 61, 61', . . . 64, 64', 65'.

FIG. 7 schematically illustrates the distribution of the toothed gears inside the gearbox. A motor 91 provides power to the entry part of the machine via a gear reducer 81. The output shaft of this gear reducer is linked by coupling to the shaft which carries the pinion gear P'1, the same shaft via its other end attacks the lower roll 41' via the hinged extension shaft 61' . . . . Pinion gear P'1 by meshing transmits the movement to pinion gears P2 and P1 respectively linked to rolls 42 and 41 via a hinged shaft 62 and 61 respectively. Finally pinion gear P1 by meshing transmits the movement to pinion gear P'0 which is linked to roll 40' via a hinged extension 60', and pinion gear P2 by meshing transmits the movement to pinion gear P'2 which is linked to roll 42' via a hinged extension 62'. Therefore all the work rolls of the first part of the machine are driven in rotation in the direction suitable for travel of the product 10 and for transmission of the necessary power for deformation of the product.

In equivalent manner, the second part of the machine is driven by motor 92 via a gear reducer 82. The output shaft of this gear reducer is linked via coupling with the shaft which carries pinion gear P'4 of the gearbox. The same shaft is linked at its other end to roll 44' via a hinged extension 64'. Pinion gear P'4 by meshing drives pinion gears P5 and P4 which in turn by meshing drive pinion gears P'5 and P'3 respectively, pinion gear P'3 drives pinion P3 by meshing therewith. In similar manner to the first part of the machine, the shafts of pinion gears P3, P'3, P4, P'4, P5 and P'5 are connected to the work rolls 43, 43', 44, 44', 45 and 45' via hinged extensions 63, 63', 64, 64', 65 and 65'. Therefore all the work rolls of the exit section of the levelling machine are driven in rotation in the direction that is suitable for travel of the product 10 and can transmit the necessary deformation energy for levelling.

It is usual to determine the torque values transmitted by measuring the current intensities of motors 91 and 92, or by any other suitable means installed in the couplings or in the hinged extensions. Said means are well known and do not need to be further detailed.

The method of the invention is the adjustment of roll intermesh based on the differences detected in transmitted torques, and for this purpose in the method of the invention adjustment of the speed of rotation of the rolls must be associated therewith.

Figure 4:
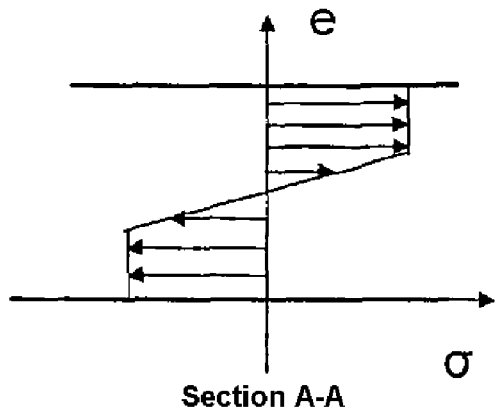
FIG. 4 schematically illustrates adjustment that is subject of the invention.
Figure 4:
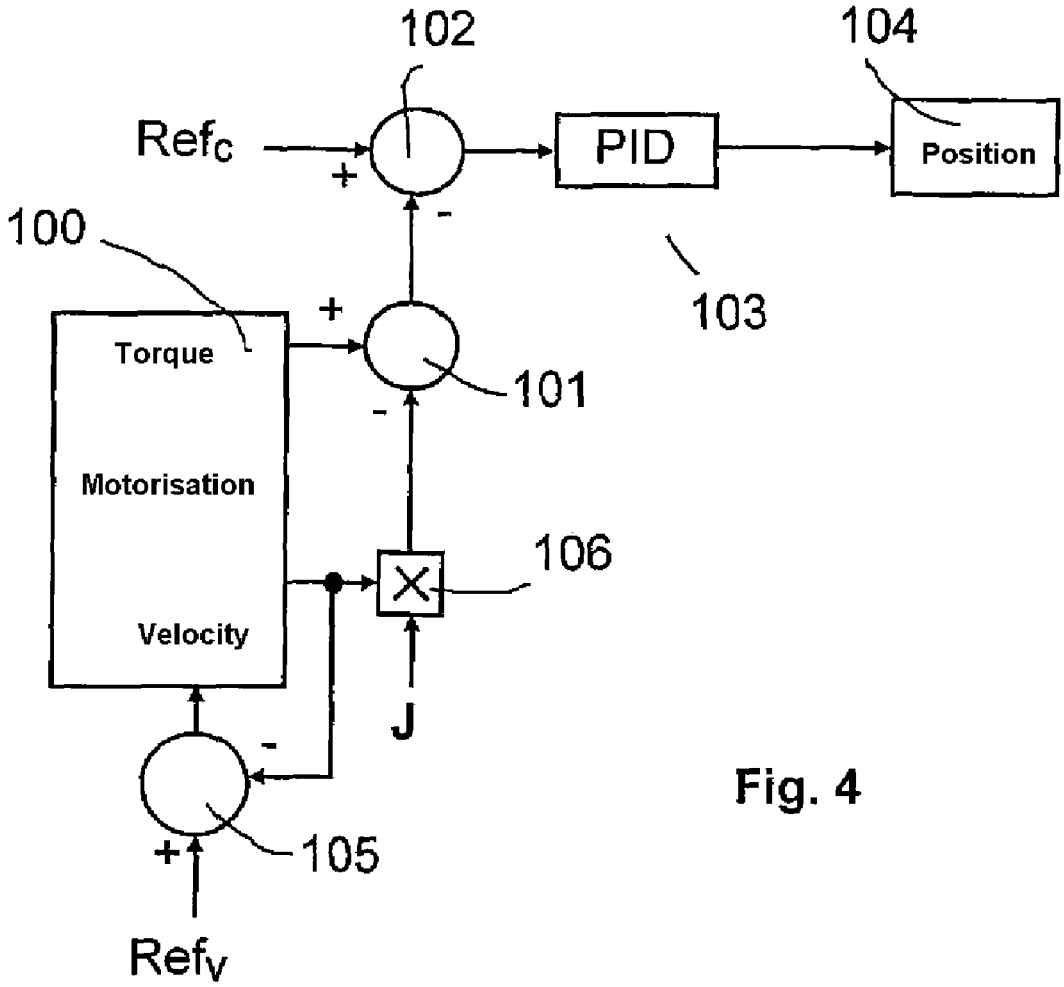

FIG. 4 schematically illustrates this adjustment according to one embodiment of the device of the invention. Module 100 represents the motorization of the rolls and symbolizes the motors, their supply and the control and adjustment circuits.

All these circuits are conventional circuits to control the speed and torque of electric motors. They may be applied to different types of variable speed motors: direct current motors or variable frequency asynchronous motors. It is not necessary to give further details of these circuits and technologies well known to persons skilled in the art.

The levelling machine may be actuated by a single motor or by two main motors as explained above. It is also possible to envision a machine in which each work roll 4 has individual motorization. The principle of the method of the invention can be applied in similar manner. The module 100 comprises rotational speed adjustment for the motors which is evidently the same for all the rolls and operates with the same velocity reference Refv, this reference corresponds to the velocity at which it is desired to move the product 10 and to the direction of travel S.

In the motorization device 100 the torque provided by the motor(s) is measured, either by intensity measurement or by appropriate devices installed on the transmission shafts. This torque measurement is entered into a first comparator 101. Evidently the torque provided by the motors does not correspond exactly to the torque needed for plastic deformation which is the only value which can be used for the method. In general, the functioning of a levelling machine effectively requires major accelerations to reach the intended velocity for levelling. The motors therefore supply an acceleration torque which must be deducted. For this purpose a velocity signal derived from module 100 is fed into a multiplier 106 which also receives the value of the total inertia J of the rotating parts of the levelling machine.

This acceleration torque is deducted from the torque measured by the comparator 101. In the general case of a machine having a single motor, no other torque exists since, as mentioned, the sum of the elastic work is zero on each roll and since the machine operates without tension in the product at the entry and exit ends the motor does not supply any additional torque. Therefore at the output of the comparator 101 there is a signal representing the torque used for plastic deformation of the product 10. This signal is compared by means of circuit 102 with the reference value $Ref_c$ given by the theoretical model or by the pre-adjustment device.

The difference between these two values, according to the invention, will be used to correct the intermesh of the rolls. As it has already been seen that the variation in torque is substantially proportional to intermesh, the adjustment device 103 according to the invention may comprise an adjustment circuit which is a PID amplifier (proportional, integral and differential). In the case in hand the integral part is the one chiefly used to ensure stability of the device. The adjustment circuit delivers a signal to the intermesh control circuit 104 which adjusts the positions of the jacks 3, 3', by varying the position of the upper slab 14. This action is performed by means of a hydraulic circuit comprising pumps and servovalves for example, but it can also be performed by any device able to move the slab 14 controllably. These hydraulic technologies are widely used today in various areas and particularly for clamping devices of levelling machines and mill stands, they have been the subject of numerous patents and will therefore not be further detailed.

According to a more improved embodiment of the device of the invention, a levelling machine can be considered having one motorization of the entry part and one motorization for the exit part as per the illustration FIGS. 6 and 7. Two separate adjustment circuits are needed of the type shown FIG. 4. The entry part of the machine in which strong plastic deformation is carried out may function in the manner described above based on torque measurement corresponding to the torque of the motor controlling the entry levelling rolls. The adjustment circuit 104 will control the hydraulic jacks 3 located on the entry side. On the other hand it is not possible to provide for a device that is exactly identical for adjustment of the exit section of the machine. In general tension is set up in the product between the entry section and the exit section owing to different plastic deformation rates between the two sections.

One part of the machine operates with strong curvatures and the other with smaller curvatures; if there is no slip the rolls impose the speed of the metal sheet face in contact and hence a slightly higher speed for the neutral axis, the overspeed being proportional to the curvature at the point of contact. The speed of the neutral axis is the same throughout the entire machine. With rolls that are mechanically coupled tensions/compressions occur between the rolls and cause slippage between the product and the rolls, which solve velocity discrepancies. These tensions set up a motive torque or resistance torque depending on the roll under consideration. When the different parts of the levelling machine have different motorizations, these torques are offset by additional torques provided by the motors. The image of the deformation work being carried out by the roll is therefore distorted by the exchange of power brought about by these tensions.

These must be taken into account for adjustment. To do so it is necessary to measure the tensions which come to exist between the different parts of the machine having different motorizations, and to evaluate the differences in tension forces $\Delta T$. The additional torques taken in charge by the motor are then of $R\Delta T$ type, R being the radius of a levelling roll, and the appropriate adjustment circuit is of the type illustrated FIG. 4*bis*. This circuit is similar to the preceding circuit, the measured torque value induced by the tensions simply having to be corrected by inputting the signal $R\Delta T$ (107) into a differentiating input of the comparator 101. The functioning is then the same as previously and the intermesh control circuit 104 acts on the hydraulic jacks 3' located on the exit side of the levelling machine. It can also be envisioned not to fully separate the actions exerted on the jacks 3 located at the entry side from the action exerted on jacks 3' located at the exit, and to mix the control signals with appropriate action percentages.

Regarding machines in which all the work rolls are driven individually, and according to an improved variant of the method of the invention, it is necessary to use devices allowing determination of the tension in the product 10 at all the intervals located between the work rolls. The device of the invention then consists of adjustment circuits of the type shown FIG. 4*bis*, and it is possible to control the intermesh of each roll individually, e.g. by installing suitable devices at the adjustment members 52.

In this type of machine, it is also possible to imagine other types of functioning, by first acting individually on each work roll based on measurement of the torque on its driving motor, and second by combining a global action by means of hydraulic jacks 3, 3' and using an adjustment signal obtained by combining the individual adjustment signals.

However the invention is not limited to the embodiment described merely by way of example, since variants may be used without departing from the scope of the claims. In particular, levelling machines may be used provided with other types of devices to adjust the intermesh of the work rolls, or other methods and measurements may be used with which to determine the torques required for plastic deformation of the product.

The reference signs inserted after the technical characteristics mentioned in the claims are solely intended to facilitate the understanding of the claims and in no way limit the scope thereof.

The invention claimed is:

1. A method for levelling a flat product in strip or sheet form in a levelling machine, the method comprising the following steps:

providing a fixed support stand, providing two levelling trains with parallel rollers respectively positioned above and below said strip or sheet, providing devices for adjusting an intermesh of the rolls, providing motorization means for transmitting torques to the levelling rolls, providing means for at least global measurement of the torques transmitted to the levelling rolls by the motorization means, providing a pre-adjustment device giving at least one velocity reference value for the motorization means of the levelling rolls and for an electric torque value required for plastic deformation of the product, measuring at least the global value of the torques transmitted to the levelling rolls, determining a real value of the torques used for plastic deformation of the product, comparing the determined real value with the torque reference value given by the pre-adjustment model, and acting on the adjusting devices to adjust the intermesh of the levelling rolls to maintain the determined torque value used for plastic deformation of the product equal to the reference value given by the model.

2. The method for levelling a flat product in strip or sheet form in a levelling machine according to claim 1, further comprising determining the real value of the torques used for plastic deformation of the product by correcting a measurement with acceleration and deceleration torque values used during speed changes of the levelling machine.

3. The method for levelling a flat product in strip or sheet form according to claim 1, further comprising providing the levelling machine with several parts whose rolls are motorized independently in groups, each group corresponding to one of the parts of the levelling machine, each part comprising separate means for roll intermesh, a pre-adjustment device giving at least one reference velocity value for the motors of the levelling rolls and for the value of the electric value required for plastic deformation of the product in each part of the machine, measuring, in each part, at least the global value of the torques transmitted to the corresponding group of levelling rolls and determining the real value of the torques used for plastic deformation of the product in each of the parts, comparing the determined value with the reference torque value given by the pre-adjustment model for the same part of the machine, and exerting action on adjusting devices to adjust the intermesh of the levelling rolls of said part in order to maintain the torque value thus determined used for plastic deformation of the product equal to the reference value given by the model.

4. The method for levelling a flat product in strip or sheet form in a levelling machine according to claim 3, further comprising determining the real value of the torques used for plastic deformation of the product in each part of the machine by correcting the measurement with the acceleration and deceleration torque values used during speed changes of the levelling machine.

5. The method for levelling a flat product in strip or sheet form in a levelling machine according to claim 3, further comprising making by measurement or calculation a determination of a tension induced in the product by the different parts of the machine having independent motorization, and for each part inferring the real value of the torques used for plastic deformation of the product thereupon by correcting the measurement with the torque values required for tension equilibrium within the product in zones located between each part of the levelling machine.

6. The method for levelling a flat product in strip or sheet form according to claim 1, further comprising providing the levelling machine with two parts, an entry part and an exit part respectively, whose rolls are motorized independently in two groups, each said group corresponding to one of the parts of the levelling machine, the intermesh of the entry rolls being controlled by entry clamping means of the machine and respectively the intermesh of the exit rolls being more particularly controlled by exit clamping means of the machine, a pre-adjustment device giving at least one reference velocity value for the motors of the levelling rolls and for the value of the electric torque required for plastic deformation of the product in each part of the machine, measuring on the entry rolls and exit rolls respectively at least the global value of the transmitted torques, and determining the real value of the torques used for plastic deformation of the product at the entry and exit respectively, comparing the determined value with the reference torque value given by the pre-adjustment model for the machine entry and exit respectively, and exerting action on the members adjusting the intermesh of the entry levelling rolls, and the members for the exit levelling rolls, to maintain the determined torque value used for plastic deformation of the product equal to the reference value given by the model.

7. The method for levelling a flat product in strip or sheet form in a levelling machine according to claim 6, further comprising determining the real value of the torques used for plastic deformation of the product at the machine entry and exit respectively, by correcting the measurement with the acceleration and deceleration torque values used during speed changes of the levelling machine.

8. The method for levelling a flat product in strip or sheet form in a levelling machine according to claim 6, further comprising determining by measurement or calculation a value of a tension induced in the product in a zone located between the entry rolls and exit rolls, and calculating from this value for the entry and for the exit the real value of the torques used for plastic deformation of the product, by correcting the measurement with the torques values needed for tension equilibrium within the product in said zone located between the entry rolls and the exit rolls.

9. The method for levelling a flat product in strip or sheet form according to claim 1, further comprising providing the levelling machine with rolls which are all motorized individually and independently and comprising separate intermesh means for each roll, a pre-adjustment device giving at least one reference velocity value for the motors of the levelling rolls and for the value of the electric torque required for plastic deformation of the product, measuring the value of the torque transmitted to each levelling roll and making a determination of the real value of the torques used for plastic deformation of the product, comprising the determined value with the reference torque value given by the pre-adjustment model for the same roll, and exerting action on the intermesh adjustment members of said levelling roll to maintain the determined value of the torque used for plastic deformation of the product equal to the reference value given by the model.

10. The method for levelling a flat product in strip or sheet form in a levelling machine according to claim 9, further comprising determining the real value of the torques used for plastic deformation of the product by correcting the measurement with the acceleration and deceleration torque value used during speed changes of the levelling machine.

11. The method for levelling a flat product in strip or sheet form in a levelling machine according to claim 9, further comprising making a determination of the tension induced in the product between each roll by measurement or by calculation, and for each roll determining the real value of the torque used for plastic deformation of the product by correcting the measurement with the torque values needed to equalize tension differences in the product upstream and downstream of each roll.

12. In a machine for leveling flat products in strip or sheet form including a fixed support stand, two leveling trains with parallel rollers, devices for adjusting roll intermesh, motorization means for the levelling rolls, means for at least global measurement of torques transmitted to the levelling rolls by the motorization means, and a pre-adjustment device giving at least one reference velocity value for the motorization means of the levelling rolls and for a value of an electric torque required for plastic deformation of the product, an adjustment device for adjusting an intermesh of the rolls in the machine, the adjustment device comprising:

means for determining a real value of the torques used for plastic deformation of the products, a roll velocity adjustment circuit connected to the pre-adjustment device and allowing a servo-control by the reference velocity value given by the model, and a roll intermesh adjustment circuit connected to the roll velocity adjustment circuit and acting on a position of the rolls by adjusting a difference between a reference torque required for plastic deformation of the product given by the model and a measurement taken on the rolls.

13. The adjustment device for adjusting the intermesh of the rolls in a machine for leveling flat products according to claim 12, which further comprises several parts whose rolls are motorized independently in groups, each group corresponding to one of the parts of the levelling machine, each part comprising separate roll intermesh means, said adjustment device comprising a roll velocity adjustment circuit allowing servo-control by the reference velocity given by the model, and a roll intermesh adjustment circuit for each part acting separately on the position of the rolls of each part.

14. The adjustment device for adjusting the intermesh of the rolls in a machine for leveling flat products according to claim 12, wherein the rolls are all motorized independently, each roll comprising separate intermesh means, a roll velocity adjustment circuit allowing its servo-control by the reference velocity given by the model, and a separate intermesh adjustment circuit for each of the rolls acting separately on the position of said rolls.

15. The adjustment device for adjusting the intermesh of the rolls in a machine for leveling products according to claim 12, wherein said adjustment device is a proportional, integral and differential (PID) amplifier and comprises inputs for acceleration signals of the machine and for differences in tension induced in the product between upstream and downstream zones of each roll.

* * * * *